US007201709B1

(12) United States Patent
Pebbles, Jr.

(10) Patent No.: US 7,201,709 B1
(45) Date of Patent: Apr. 10, 2007

(54) TRAINING APPARATUS

(76) Inventor: Robert A. Pebbles, Jr., 444 N. Liberty Rd., Grove City, PA (US) 16127

( * ) Notice: Subject to any disclaimer, the term of this patent is extended or adjusted under 35 U.S.C. 154(b) by 0 days.

(21) Appl. No.: 11/405,110

(22) Filed: Apr. 17, 2006

(51) Int. Cl.
*A63B 21/068* (2006.01)
*A63B 21/06* (2006.01)
*A63G 11/00* (2006.01)
*A63G 13/06* (2006.01)

(52) U.S. Cl. ..... 482/95; 482/96; 482/72; 472/95; 472/106

(58) Field of Classification Search ..... 482/72, 482/95, 96, 133, 135; 472/95, 106, 108, 472/110–112; D21/674
See application file for complete search history.

(56) References Cited

U.S. PATENT DOCUMENTS 2,145,940 A * 2/1939 Marlowe ..... 482/72
2,419,998 A * 5/1947 Johnson ..... 601/36
4,743,010 A * 5/1988 Geraci ..... 482/72
5,366,428 A * 11/1994 Liao ..... 482/96
5,453,066 A * 9/1995 Richter, Jr. ..... 482/96
5,527,243 A * 6/1996 Chen ..... 482/72
5,533,953 A * 7/1996 Lui et al. ..... 482/96
5,674,161 A * 10/1997 Lin ..... 482/96
5,827,158 A * 10/1998 Drecksel ..... 482/96
6,984,196 B2 * 1/2006 Tornabene et al. ..... 482/140

* cited by examiner

*Primary Examiner*—Stephen R. Crow
*Assistant Examiner*—Allana Lewin

(57) ABSTRACT

A training apparatus is disclosed. An illustrative embodiment of the training apparatus includes a base frame, a saddle pivotally carried by the base frame and a handle pivotally carried by the base frame and engaging the saddle.

13 Claims, 5 Drawing Sheets

TRAINING APPARATUS

FIELD

The present invention relates to apparatus for training riders in proper horseback riding technique. More particularly, the present invention relates to a training apparatus which facilitates the training of riders in proper horseback riding techniques in an effective and safe manner.

BACKGROUND

In many parts of the world, horseback riding is a popular pastime as well as a common mode of transportation. Horseback riding and jumping is also a popular sport. Beginning horseback riders, particularly children, need to be taught proper horseback riding technique such as posture, balance, positioning and breathing. Typically, these skills are taught as the beginner rides on a horse. However, during the training period, the unskilled beginner is often in danger of inadvertently falling off the horse and injuring himself or herself.

SUMMARY

The present invention is generally directed to a training apparatus. An illustrative embodiment of the training apparatus includes a base frame, a saddle pivotally carried by the base frame and a handle pivotally carried by the base frame and engaging the saddle.

BRIEF DESCRIPTION OF THE DRAWINGS

The invention will now be described, by way of example, with reference to the accompanying drawings, in which.

DETAILED DESCRIPTION

Figure 8:
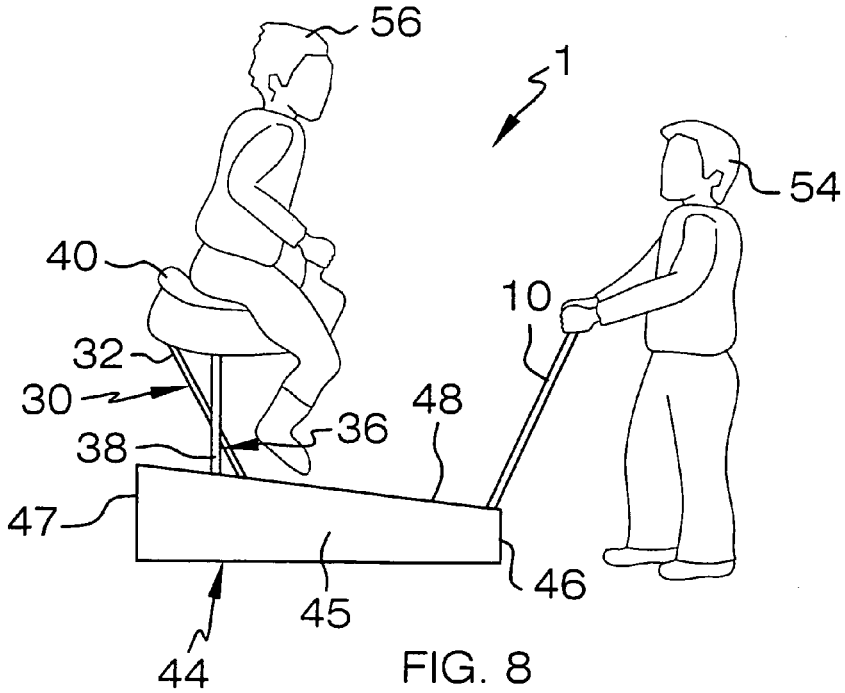
FIG. 8 is a side view illustrating typical use of an illustrative embodiment of the training apparatus.

Referring to the drawings, an illustrative embodiment of a training apparatus according to the present invention is generally indicated by reference numeral 1. Briefly, as shown in FIG. 8, the training apparatus 1 is suitable for use by a trainer 54 in training a trainee 56 in proper horseback riding technique, such as posture, balance, positioning and breathing, for example, as will be hereinafter further described.

Figure 7:
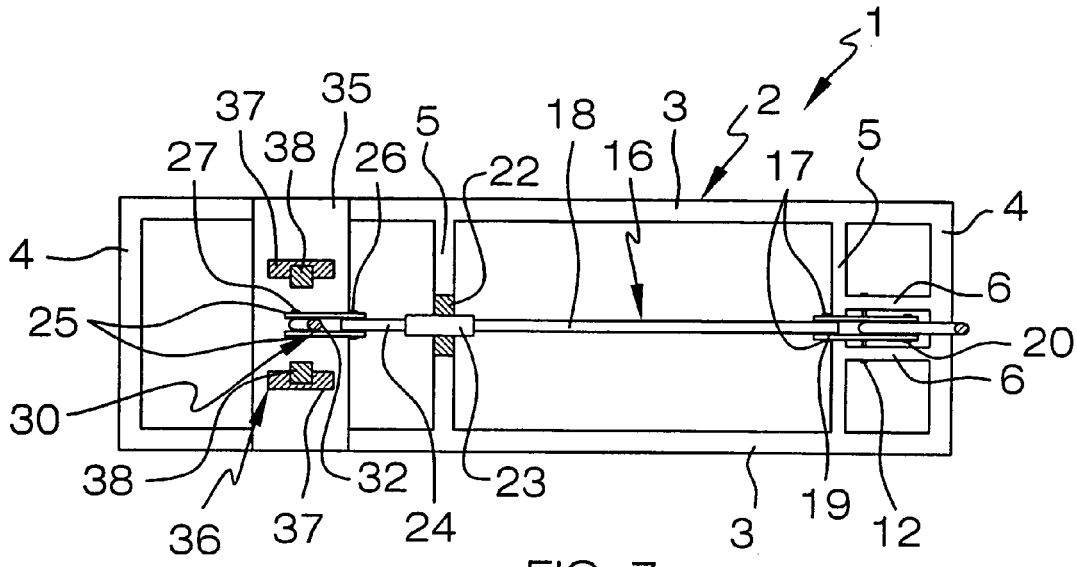
FIG. 7 is a top view of an illustrative embodiment of the training apparatus, with the housing removed from the base frame.

The training apparatus 1 includes a base frame 2 which may have a generally elongated, rectangular or alternative configuration. The base frame 2 typically includes a pair of generally parallel longitudinal frame members 3, transverse frame members 4 connecting the longitudinal frame members 3, and one or multiple frame stabilizers 5 spanning the longitudinal frame members 3. A pair of spaced-apart handle mount members 6 may extend between a transverse frame member 4 and a frame stabilizer 5 of the base frame 2, for purposes which will be hereinafter described. As shown in FIG. 7, a frame plate 35 is typically provided on the longitudinal frame members 3, in spaced-apart relationship to the handle mount members 6.

An elongated handle 10 is pivotally mounted to the base frame 2. For example, the lower end of the handle 10 may be pivotally mounted between the handle mount members 6 via a pivot pin 12. A handle grip 11, which may be rubber or plastic, for example, may be provided on the upper end of the handle 10. As shown in FIGS. 4–7, a handle linkage 16 is connected to the handle 10. As shown in FIG. 7, the handle linkage 16 typically includes a pair of spaced-apart linkage flanges 17 which are pivotally attached to the handle 10 via a pivot pin 20. One end of an elongated linkage shaft 18 is pivotally attached to the linkage flanges 17 via pivot pin 19. A shaft cylinder 23 is provided on the opposite end of the linkage shaft 18. The shaft cylinder 23 may be mounted on a cylinder mount 22 which is supported on the base frame 2, such as on a frame stabilizer 5, for example. An actuator shaft 24 is telescopically extendable from the shaft cylinder 22. A pair of spaced-apart actuator flanges 25 is pivotally attached to the actuator shaft 24 via a pivot pin 26.

An elongated frame linkage 30 includes a bottom linkage member 31 which is pivotally attached to the actuator flanges 25 via a pivot pin 27. A top linkage member 32 is pivotally attached to the bottom linkage member 31 via a pivot pin 33. The purpose of the frame linkage 30 will be hereinafter described.

Figure 1:
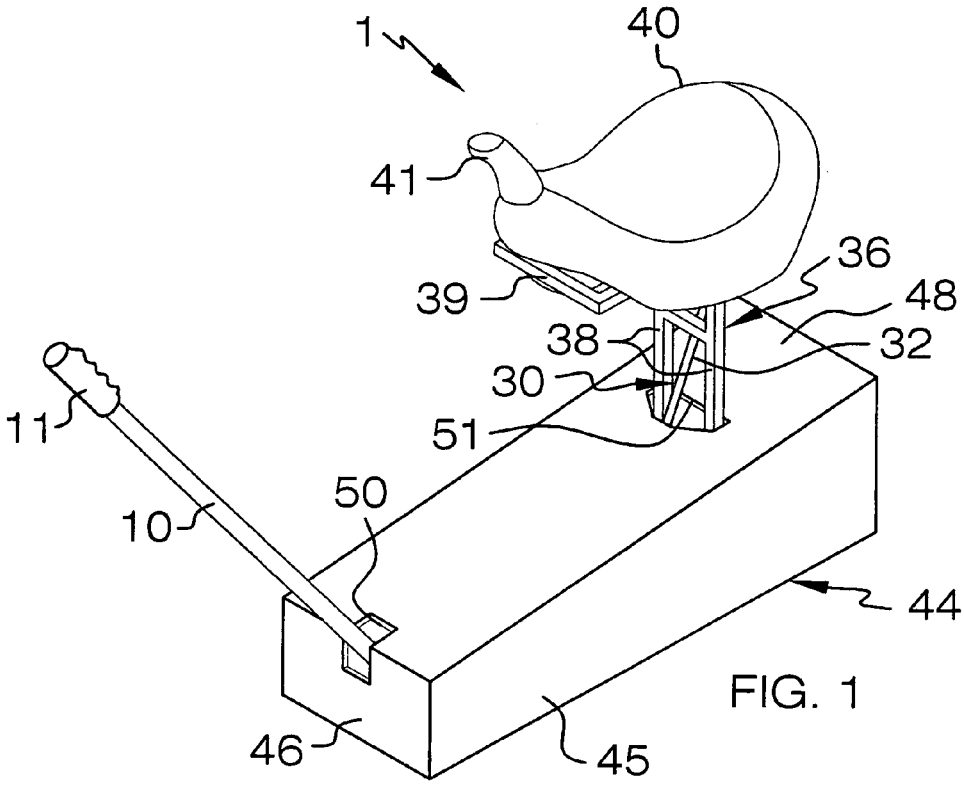
FIG. 1 is a front perspective view of an illustrative embodiment of a training apparatus.
Figure 2:
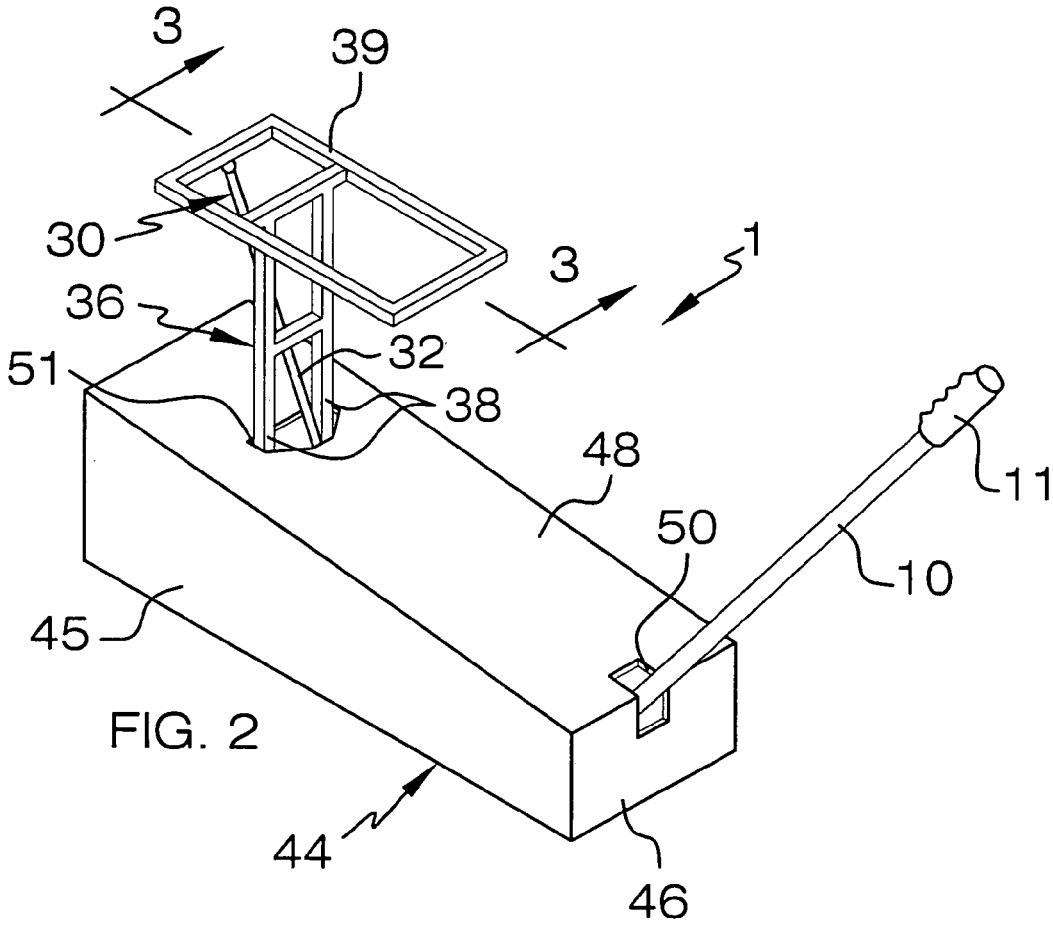
FIG. 2 is a front perspective view of an illustrative embodiment of a training apparatus, with a saddle removed from a saddle support frame component of the apparatus.
Figure 3:
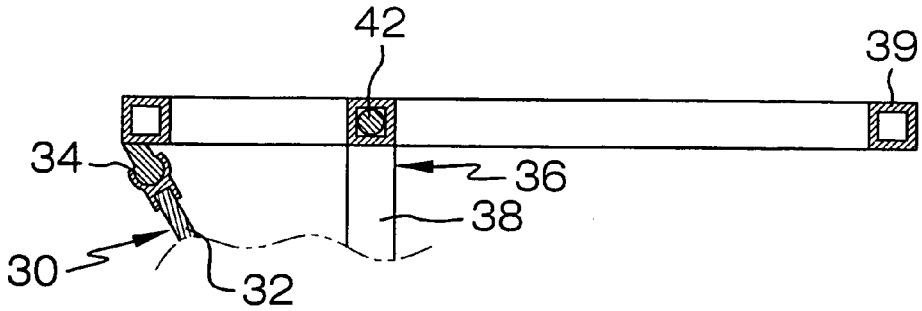
FIG. 3 is a sectional view, taken along section lines 3—3 in FIG. 2, of a saddle frame.
Figure 4:
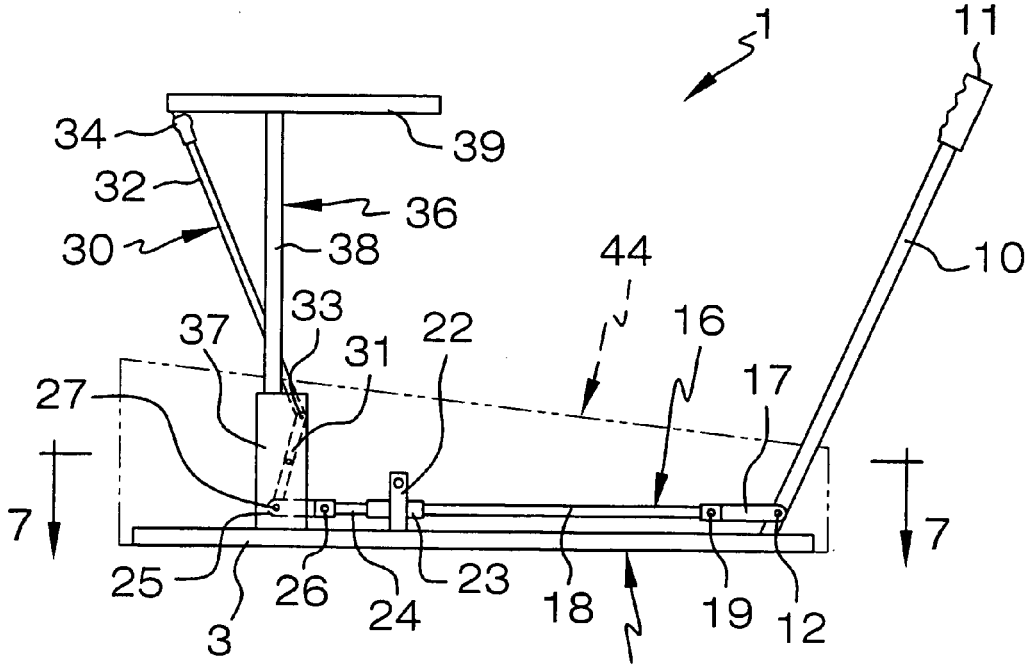
FIG. 4 is a side view of an illustrative embodiment of the training apparatus, with a housing (shown in phantom) provided on a base frame of the apparatus and more particularly illustrating the saddle frame in a generally horizontal position.
Figure 5:
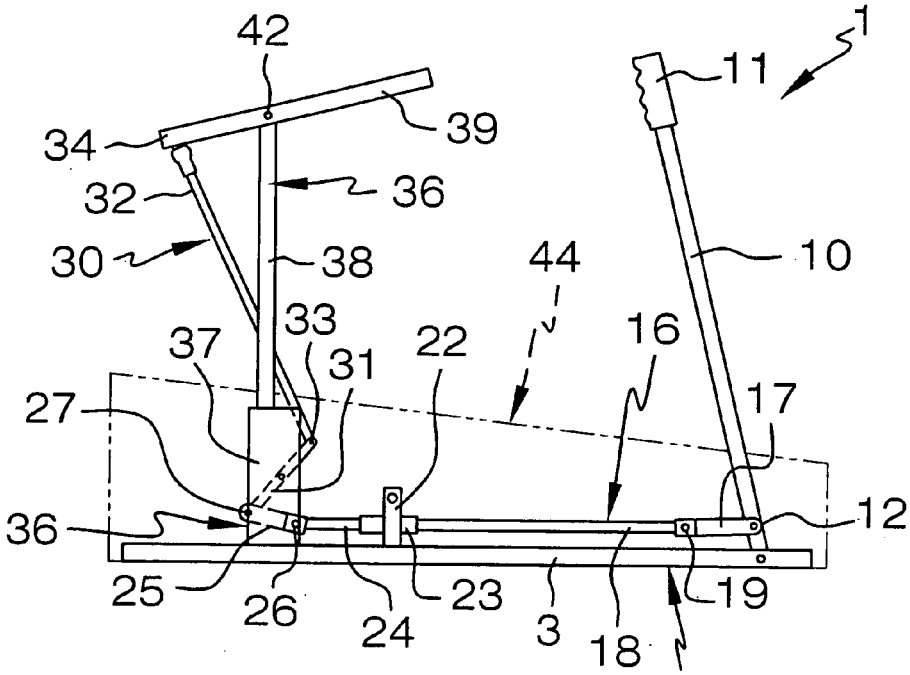
FIG. 5 is a side view of an illustrative embodiment of the training apparatus, with a housing (shown in phantom) provided on a base frame of the apparatus and more particularly illustrating the saddle frame in a rearwardly-tilted position.
Figure 6:
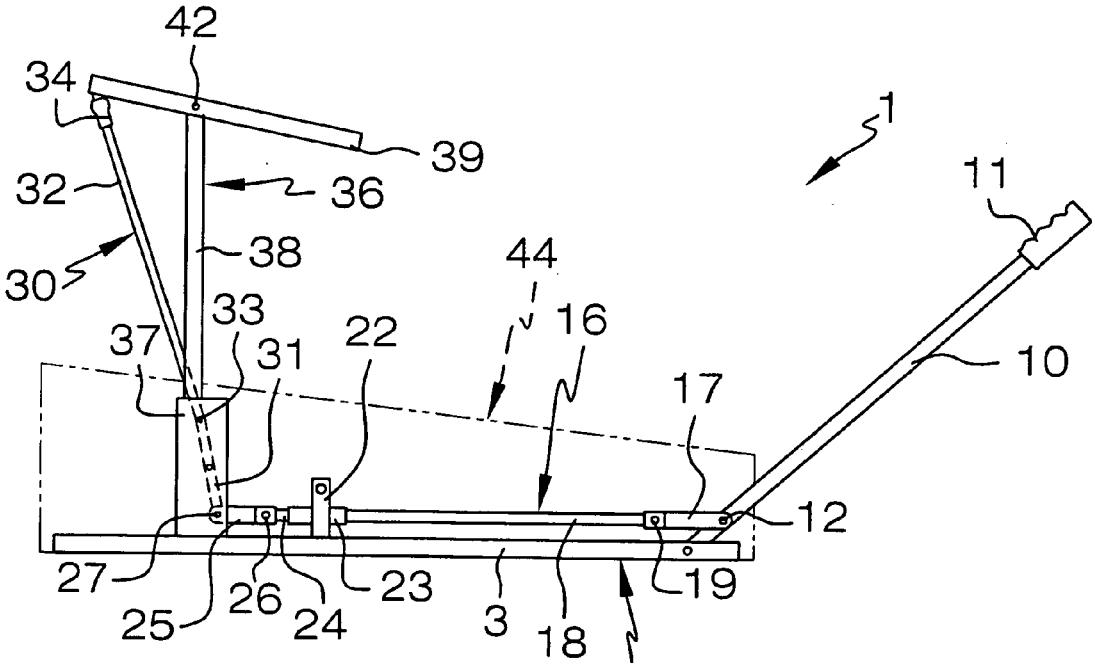
FIG. 6 is a side view of an illustrative embodiment of the training apparatus, with a housing (shown in phantom) provided on a base frame of the apparatus and more particularly illustrating the saddle frame in a forwardly-tilted position.

A saddle support frame 36 is provided on the frame plate 35. The saddle support frame 36 may include, for example, a pair of spaced-apart base members 37 which extends upwardly from the frame plate 35. A pair of support members 38 is welded, fastened and/or otherwise attached to the respective base members 37. A saddle frame 39 is pivotally mounted on the support members 38 at a pivot point 42 (FIG. 3) which is adjacent to the middle of the saddle frame 39. The pivot point 42 may be slightly closer to the rear end than to the front end of the saddle frame 39. As shown in FIG. 3, the top linkage member 32 of the frame linkage 30 is pivotally attached to the rear end of the saddle frame 39 at a pivoting attachment point 34. Accordingly, pivoting of the handle 10 on the base frame 2 toward the saddle support frame 36 causes the handle linkage 16 and the frame linkage 30 to tilt the saddle frame 39 rearwardly on the saddle support frame 36, as shown in FIG. 5. Pivoting of the handle 10 on the base frame 2 away from the saddle support frame 36 causes the handle linkage 16 and the frame linkage 30 to tilt the saddle frame 39 forwardly on the saddle support frame 36, as shown in FIG. 6. In the intermediate position of the handle 10, the saddle frame 39 is disposed in a generally horizontal position, as shown in FIG. 4. As shown in FIGS. 1 and 2, a saddle 40, which may include a saddle horn 41, is provided on the saddle frame 39.

A housing 44 may be provided on the base frame 2. As shown in FIGS. 1 and 2, the housing 44 may include, for example, a pair of side panels 45; a front panel 46 and a rear panel 47 connecting the side panels 45; and a top panel 48 provided on the side panels 45, the front panel 46 and the rear panel 47. A handle opening 50 is provided in the front panel 46 and/or the top panel 48, and the handle 10 extends through the handle opening 50. A frame opening 51 is provided in the top panel 48, and the saddle support frame 36 extends through the frame opening 51.

In typical use of the training apparatus 1, as shown in FIG. 8, a trainee 56 sits on the saddle 40 and a trainer 54 operates the handle 10. The trailer 54 grasps the handle 10 and repeatedly pivots the handle in a back-and-forth motion on the base frame 2 in order to repeatedly move the position of the saddle 40 between the rearwardly-tilted position indicated by the saddle frame 39 in FIG. 5, the horizontal position of the saddle 40 indicated by the saddle frame 39 in FIG. 4 and the forwardly-tilted position indicated by the saddle frame 39 in FIG. 6. This simulates the movement of a saddle on a horse (not shown) as if the trainee 56 were riding the horse and teaches the trainee 56 proper horseback riding technique such as posture, balance, positioning and breathing throughout movement of the saddle 40.

While the preferred embodiments of the invention have been described above, it will be recognized and understood that various modifications can be made in the invention and the appended claims are intended to cover all such modifications which may fall within the spirit and scope of the invention.

What is claimed is:

1. A training apparatus, comprising:

a base frame;

a saddle pivotally carried by said base frame; and a handle pivotally carried by said base frame and engaging said saddle; and a handle linkage pivotally engaging said handle and a frame linkage pivotally engaging said handle linkage and pivotally engaging said saddle; wherein said handle linkage comprises a pair of linkage flanges pivotally attached to said handle, a linkage shaft pivotally attached to said pair of linkage flanges, a shaft cylinder carried by said linkage shaft, an actuator shaft extendable from said shaft cylinder and a pair of actuator flanges pivotally carried by said actuator shaft, and wherein said frame linkage pivotally engages said pair of actuator flanges; wherein said frame linkage comprises a bottom linkage member pivotally engaging said pair of actuator flanges and a top linkage member pivotally engaging said bottom linkage member and said saddle.

2. The training apparatus of claim 1 further comprising a housing provided on said base frame.

3. The training apparatus of claim 2 further comprising a handle opening provided in said housing and wherein said handle extends through said handle opening.

4. The training apparatus of claim 1 wherein said base frame comprises a pair of longitudinal frame members, a pair of transverse frame members connecting said pair of longitudinal frame members and a plurality of frame stabilizers spanning said pair of longitudinal frame members.

5. A training apparatus, comprising:

a base frame;

a pair of base members carried by said base frame;

a pair of support members carried by said pair of base members, respectively;

a saddle pivotally carried by said pair of support members;

a handle pivotally carried by said base frame and engaging said saddle; and a handle linkage pivotally engaging said handle and a frame linkage pivotally engaging said handle linkage and pivotally engaging said saddle; wherein said handle linkage comprises a pair of linkage flanges pivotally attached to said handle, a linkage shaft pivotally attached to said pair of linkage flanges, a shaft cylinder carried by said linkage shaft, an actuator shaft extendable from said shaft cylinder and a pair of actuator flanges pivotally carried by said actuator shaft, and wherein said frame linkage pivotally engages said pair of actuator flanges.

6. The training apparatus of claim 5 wherein said frame linkage comprises a bottom linkage member pivotally engaging said pair of actuator flanges and a top linkage member pivotally engaging said bottom linkage member and said saddle.

7. The training apparatus of claim 5 further comprising a housing provided on said base frame.

8. The training apparatus of claim 7 further comprising a handle opening provided in said housing and wherein said handle extends through said handle opening.

9. The training apparatus of claim 5 wherein said base frame comprises a pair of longitudinal frame members, a pair of transverse frame members connecting said pair of longitudinal frame members and a plurality of frame stabilizers spanning said pair of longitudinal frame members.

10. A training apparatus, comprising:

a base frame;

a pair of base members carried by said base frame;

a pair of support members carried by said pair of base members, respectively;

a saddle frame pivotally carried by said pair of support members;

a saddle carried by said saddle frame; and a handle pivotally carried by said base frame and engaging said saddle frame; and a handle linkage pivotally engaging said handle and a frame linkage pivotally engaging said handle linkage and pivotally engaging said saddle frame, wherein said handle linkage comprises a pair of linkage flanges pivotally attached to said handle, a linkage shaft pivotally attached to said pair of linkage flanges, a shaft cylinder carried by said linkage shaft, an actuator shaft extendable from said shaft cylinder and a pair of actuator flanges pivotally carried by said actuator shaft, and wherein said frame linkage pivotally engages said pair of actuator flanges.

11. The training apparatus of claim 10 wherein said frame linkage comprises a bottom linkage member pivotally engaging said pair of actuator flanges and a top linkage member pivotally engaging said bottom linkage member and said saddle.

12. The training apparatus of claim 10 further comprising a housing having a pair of side panels; a front panel and a rear panel extending between said pair of side panels; and a top panel provided on said pair of side panels, said front panel and said rear panel.

13. The training apparatus of claim 12 further comprising a handle opening provided in at least one of said top panel and said front panel of said housing and wherein said handle extends through said handle opening and a frame opening provided in said top panel and wherein said saddle support frame extends through said frame opening.

* * * * *